US005918906A

United States Patent [19]

West

[11] Patent Number: 5,918,906

[45] Date of Patent: Jul. 6, 1999

[54] CUSTOM MADE SEE THROUGH VINYL PAPERBACK BOOK COVER AND CUSTOM MADE SLIDING POINTER BOOK MARK

[76] Inventor: Zetta L. West, 624 Hovey St., Gary, Ind. 46406

[21] Appl. No.: 08/794,502

[22] Filed: Feb. 3, 1997

[51] Int. Cl.[6] ..... B42D 9/00

[52] U.S. Cl. ..... 281/42; 281/51

[58] Field of Search ..... 281/19.1, 31, 29, 281/45, 42, 51; 116/234, 235, 240, 239

[56] References Cited

U.S. PATENT DOCUMENTS 4,886,299 12/1989 Ducorday ..... 281/31

5,004,514 4/1991 Pugliese et al. ..... 281/31 X 5,472,237 12/1995 Rajeswaran ..... 281/19.1

*Primary Examiner*—Willmon Fridie, Jr.

[57] ABSTRACT

The purpose of the book mark's attached sliding pointer is to identify the exact point where last text was read from the paperback book. It also marks the exact paragraph and/or sentence that was last read. Further, the custom made sliding pointer bookmark is designed and constructed to provide a guide and quick reference. The custom made sliding pointer bookmark is constructed in only 1 size.

1 Claim, 4 Drawing Sheets

CUSTOM MADE SEE THROUGH VINYL PAPERBACK BOOK COVER AND CUSTOM MADE SLIDING POINTER BOOK MARK

BACKGROUND OF THE INVENTION

The present invention relates to bookmarks and more particularly to specialized bookmarks capable of returning a reader to the exact page, column and line desired.

Other objects, features, and advantages of the invention may be best understood by reference to the following detailed description taken in conjunction with the accompanying drawings in which like reference numerals indicate like parts and the purpose of the bookmark is to precisely mark the exact page last read. The purpose of the bookmark's attached sliding pointer is to identify the exact paragraph and/or sentence that was last read. Further, the custom made sliding pointer bookmark is designed and constructed to provide a guide and quick reference.

SUMMARY OF THE INVENTION

The custom made sliding pointer bookmark is constructed with 4 millimeter thick clear vinyl and 2 millimeter thick fancy ribbon. The vinyl and ribbon are precisely measured and cut. Two sections of vinyl are cut exactly cut 7 and ½ inches length and 1 inch width for the bookmark. One strip of fancy ribbon is cut exactly 7 and ¼ inches length and ½ inch width for the bookmark. At the top end of the fancy ribbon a v-shape centered and cut exactly ¼ inches.

After the vinyl and the fancy ribbon are cut to the exact size for the bookmark, the fancy ribbon is then centered between the two vinyl strips which are then sewn together exactly ⅛ inch around the entire border of the vinyl on a domestic sewing machine using 100% polyester thread with a set tension of 5, and 8 zig zag stitching.

To sections of vinyl are cut exactly 5 and ½ inches in length and ¾ inch in width for the sliding pointer. An exact 45 degree angle is cut at both the left and right ends of the vinyl for the sliding pointer. One strip of fancy ribbon is cut exactly 5 inches in length an exactly ½ inch in width with exactly a 45 degree angle cut at the left and right ends of the fancy ribbon for the sliding pointer.

After the vinyl and fancy ribbon are cut to size for the sliding pointer, the ribbon is centered between the vinyl strips which are then sewn together exactly ⅛ inch around the entire border of the vinyl on a sewing domestic machine with 100% polyester thread with a set tension of 5, and 8 zig zag stitching.

The stitched sliding pointer is then folded equally in half creating a straight side on the left and exactly a 45 degree angled half arrow shape with a point on the right end. The sliding pointer is then sewn on a domestic sewing machine with 100% polyester thread ⅛ inch around the entire border of the vinyl with a set tension of 5, and 8 zig zag stitching. The exact measurements are 2 and ¾ inches.

After the sliding pointer has been completely sewn, the open center of the sliding pointer slides over the top of the bookmark.

BRIEF DESCRIPTION OF THE DRAWINGS

Additional commodities and attributes of the invention will be evident from the particulars mentioned in the drawing in which.

Figure 1:
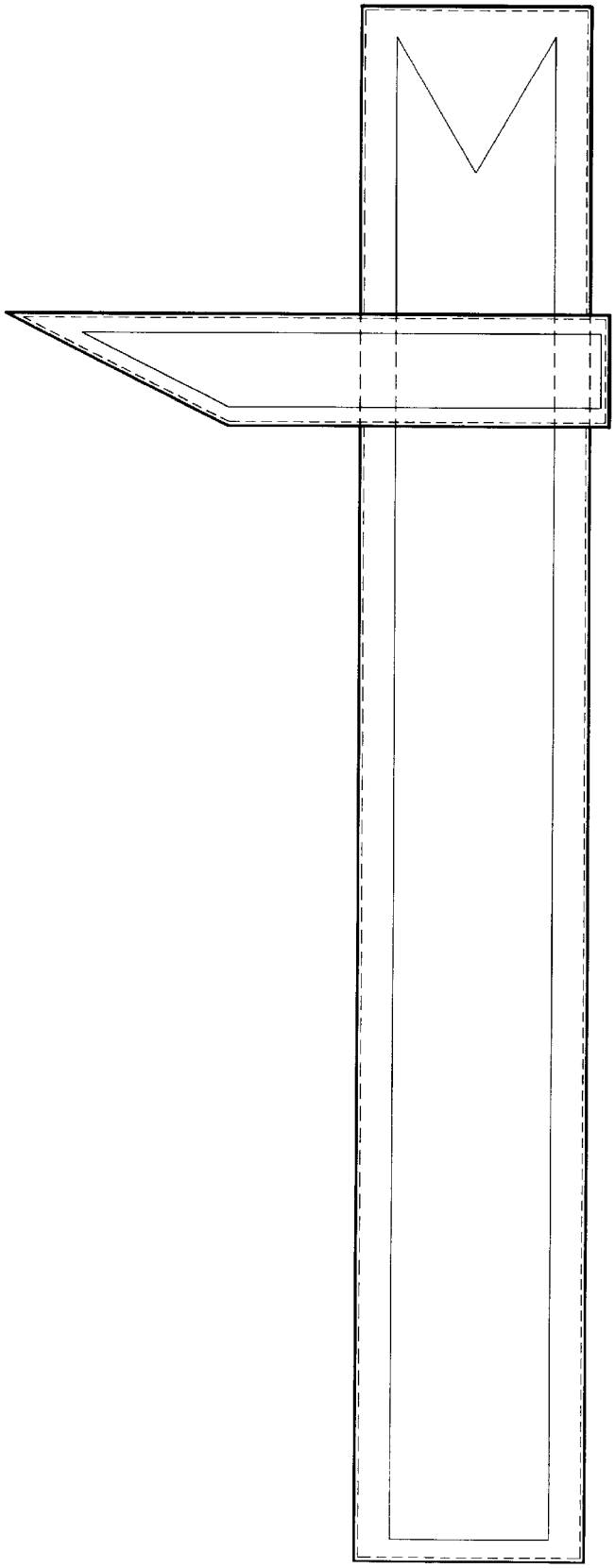
FIG. 1 is a general view point of the custom made sliding bookmark with pointer in accordance with the present invention.
Figure 2:
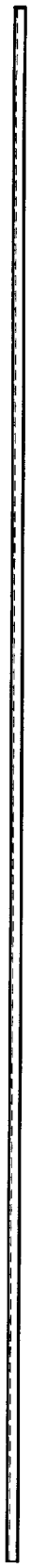
FIG. 2 is a general view point.
Figure 3:
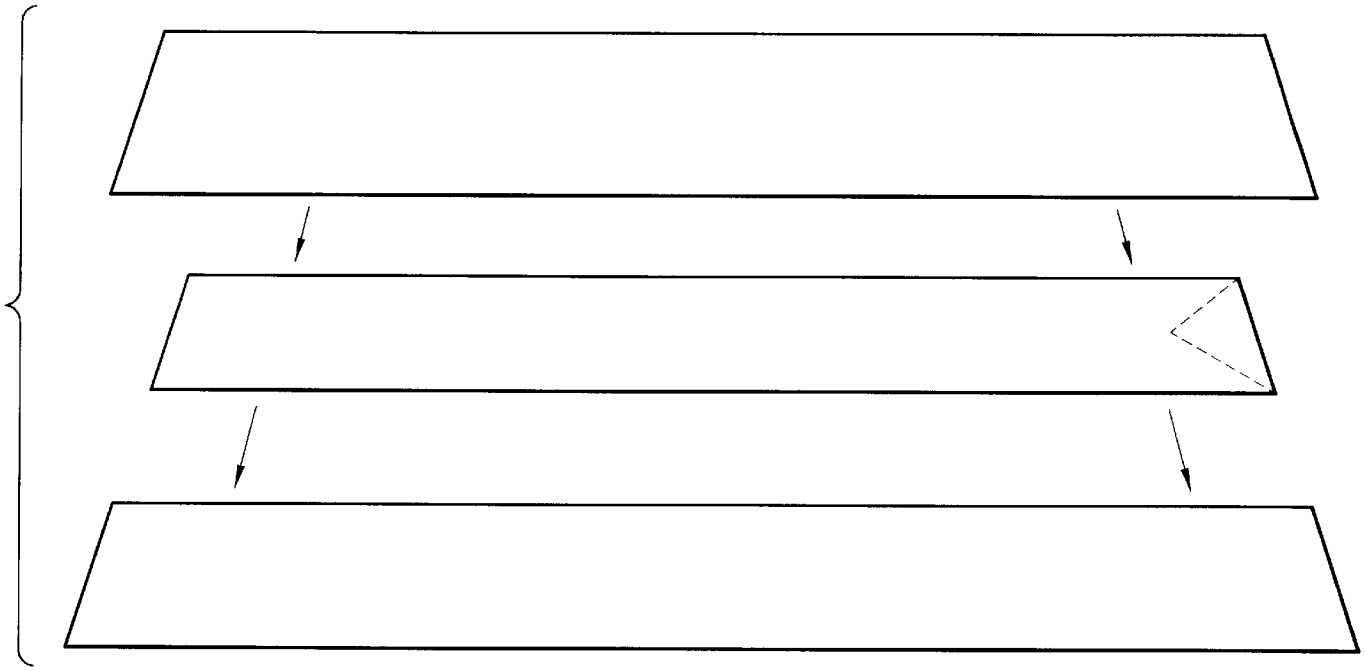
FIG. 3 is a general view point of the custom made sliding bookmark made of relatively wide strips of clear vinyl material with two comparable elongated lengths and two comparable width areas, with ribbon material with a v-shaped cut centered at the top of the ribbon, with that ribbon material sandwiched between the vinyl material for the bookmark.
Figure 4:
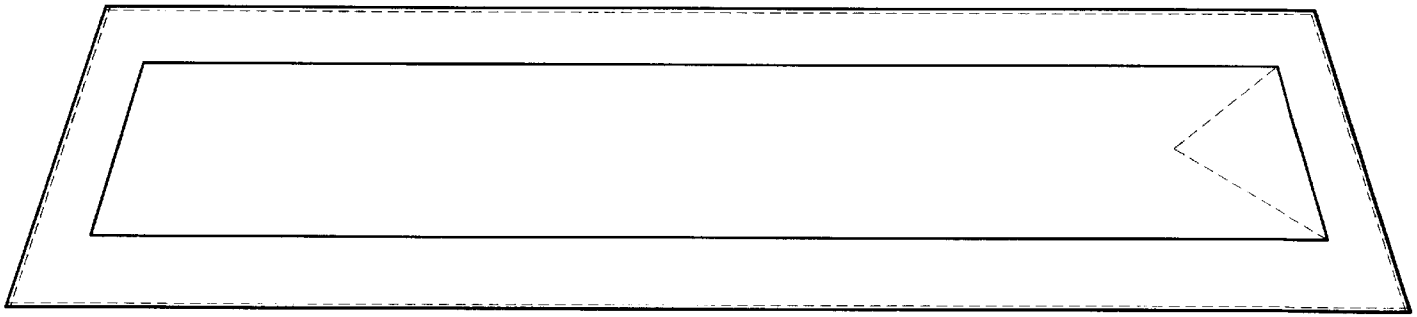
FIG. 4 is a general view point of the custom made sliding bookmark with a strip of ribbon material sandwiched in between the two strips of clear vinyl material that has been machined stitched alongside the edges of the two comparable elongated lengths and the comparable width areas.
Figure 5:
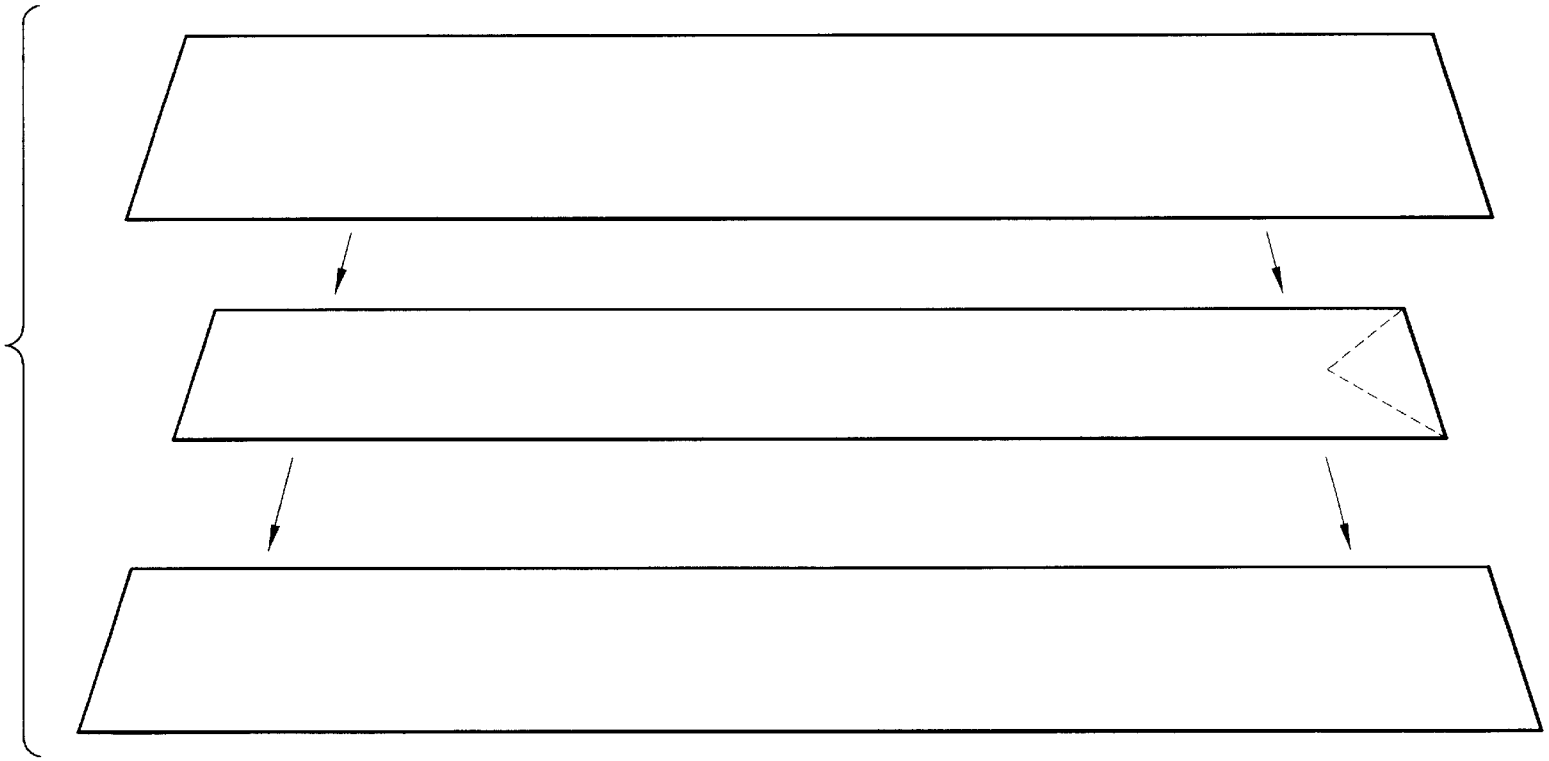
FIG. 5 is a general view point of the custom made sliding pointer, with one slightly smaller strip of ribbon material, that is sandwiched between the two comparable strips of clear vinyl material for the bookmark.
Figure 6:
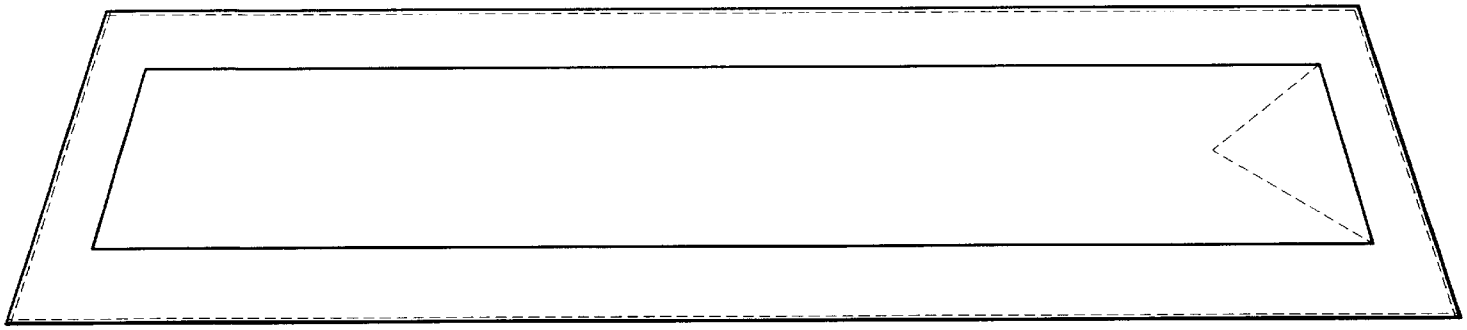
FIG. 6 is a general view point of the custom made sliding pointer with two strips of clear vinyl material.
Figure 7:
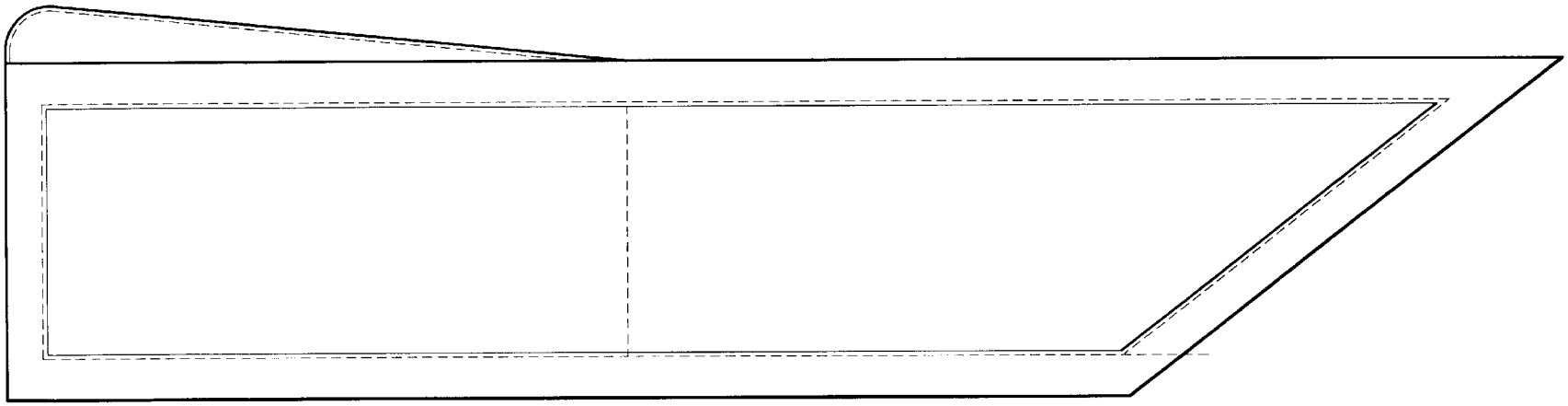
FIG. 7 is a general view point of the custom made sliding pointer that has been machine stitched alongside the edges entirely.

I claim:

1. A custom made sliding pointer bookmark providing a length slightly longer than the height of common paperback books and 1 inch width, made from clear vinyl with ribbon material sandwiched in the center of the vinyl bookmark with a sliding detaching pointer that will move up or down the bookmark providing convenient and easy placement between paperback book pages comprising the steps of:

two 7 and ½ inch comparable strips of elongated length, 1 inch in width with clear vinyl material, one 7 and ¼ inch strip of elongated length of ribbon material, ½ inch in width, one 7 and ½ inch length with 1 inch width strip of comparable elongated length of clear vinyl material, a center v-shaped cut in the top of the 7 and ¼ inch strip of elongated length ribbon material, ½ inch in width, a machine stitching alongside the elongated comparable edges and the two width areas of the clear vinyl material the stitching comprising of polyester thread, two 5 and ½ inch length of clear vinyl with a ¾ inch width with 45 degree angles at both the left and right width areas for the pointer, one strip of 5 inch ribbon material with ½ inch in width, with both left and right width area cut into 45 degree angles for the pointer, one strip of 5 and ½ inch clear vinyl with a ¾ inch width with a ¾ inch width with 45 degree angles at the left and the right width areas for the pointer.

* * * * *